US006652928B2

(12) United States Patent
Sato et al.

(10) Patent No.: US 6,652,928 B2
(45) **Date of Patent: *Nov. 25, 2003**

(54) IMAGE-TRANSFER MEDIUM FOR INK-JET PRINTING, PRODUCTION PROCESS OF TRANSFERRED IMAGE, AND CLOTH WITH TRANSFERRED IMAGE FORMED THEREON

(75) Inventors: Yuko Sato, Kawasaki (JP); Masahiko Higuma, Togane (JP); Motokazu Kobayashi, Yokohama (JP); Yoshiyuki Shino, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/234,410

(22) Filed: Jan. 21, 1999

(65) Prior Publication Data

US 2002/0098326 A1 Jul. 25, 2002

(30) Foreign Application Priority Data

Jan. 28, 1998 (JP) ..... 10-016220
Jan. 28, 1998 (JP) ..... 10-016221

(51) Int. Cl.[7] ..... B41M 5/00; B41J 2/01

(52) U.S. Cl. ..... 428/32.12; 428/32.26; 428/32.36; 428/32.38; 347/105

(58) Field of Search ..... 428/195, 327, 428/195.1, 32.12, 32.26, 32.36, 32.38; 347/105

(56) References Cited

U.S. PATENT DOCUMENTS

| | | | | | |
|---|---|---|---|---|---|
| 3,906,123 | A | * | 9/1975 | Vincent et al. | 428/411 |
| 4,091,130 | A | * | 5/1978 | Shaw | |
| 5,141,797 | A | * | 8/1992 | Wheeler | 428/195 |
| 5,501,902 | A | | 3/1996 | Kronzer | 428/323 |

FOREIGN PATENT DOCUMENTS

| | | |
|---|---|---|
| EP | 0 491 991 A1 | 7/1992 |
| EP | 0 573 676 A1 | 12/1993 |
| EP | 0 805 049 A1 | 11/1997 |
| JP | 8-207426 | 8/1996 |
| JP | 8-207450 | 8/1996 |
| JP | 10-16382 | 1/1998 |
| WO | WO 97/18090 | 5/1997 |

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is an image-transfer medium for ink-jet printing, comprising a base material, and a releasing layer and a transfer layer, both, provided on the base material, wherein the transfer layer comprises fine particles of a water-insoluble thermoplastic resin, a water-insoluble thermoplastic resin binder and a crosslinking agent coated with a thermoplastic resin.

6 Claims, No Drawings

IMAGE-TRANSFER MEDIUM FOR INK-JET PRINTING, PRODUCTION PROCESS OF TRANSFERRED IMAGE, AND CLOTH WITH TRANSFERRED IMAGE FORMED THEREON

BACKGROUND OF THE INVENTION

1. Field of the Invention

The present invention relates to an image-transfer medium suitable for use in forming an image on a transfer-printing medium by transfer-printing, a process for producing a transferred image using this image-transfer medium, and a cloth with a transferred image formed thereon, and more particularly to an image-transfer medium for ink-jet printing, in which an ink-jet printing system is used for forming an image on a transfer layer making up the image-transfer medium, a process for producing a transferred image by using such an image-transfer medium to transfer-print an image on a transfer-printing medium, thereby forming the transferred image, and a cloth with a transferred image formed thereon.

2. Related Background Art

As ink-jet printing systems, there are known various ink ejection systems, for example, an electrostatic attraction system, a system in which a piezoelectric element is used to give an ink mechanical vibration or change, and a system in which an ink is heated to form bubbles in the ink, thereby using the pressure thus produced. Printing is conducted by generating and ejecting minute droplets of an ink by one of these ink ejection systems and applying parts or all of the droplets to a recording medium. Such an ink-jet printing system is desirable because it is a simple system which produces little noise and can conduct high-speed printing and color printing. In recent years, ink-jet printers making good use of such a system, by which color printing can be simply conducted, have been widely adopted.

In recent years, the ink-jet printers, by which color printing can be simply conducted as described above, have been adopted, and there has thus been an increasing demand for conducting color printing on various recording media using these printers. In order to meet such a demand, particular attention is paid to printing techniques making good use of an image-transfer medium (image-transfer paper) in that printing can be conducted irrespective of the form of recording media (transfer-printing media), namely, image formation can be performed on any medium which does not permit direct printing by a printer.

Some image-transfer media making good use of an ink-jet printing system to form an image thereon have been proposed to date. Japanese Patent Application Laid-Open No. 8-207426 has proposed an ink-jet printing sheet in which an ink-receiving layer is composed of a thermoplastic resin, a crystalline plasticizer and a tackifier, thereby permitting sticking a transferred image to a transfer-printing medium by heating alone. Japanese Patent Application Laid-Open No. 8-207450 has proposed an image-transfer medium in the form of a sheet capable of permitting ink-jet printing and heat transfer printing, comprising a base material layer and a heat transfer layer which is composed of a particulate thermoplastic resin, inorganic porous fine particles and a binder. U.S. Pat. No. 5,501,902 has proposed an image-transfer medium for ink-jet comprising a transfer layer of a structure that a cationic resin, an ink-viscosity adjuster and the like are added in addition to the above-described components.

These image-transfer media according to the prior art have sufficient performance as to formation of an image thereon by ink-jet printing and transfer printing of the image therefrom to transfer-printing media. However, the performance as to fastness properties of the transferred images after the transfer to the transfer-printing media has not been said to be sufficient. More specifically, when washing a cloth to which an image has been transferred from such an image-transfer medium, there has been a problem that the optical density of the image is deteriorated because dyes forming the image and materials of the transfer layer carrying the image run out into water, that the transfer layer falls out due to rubbing when washed, or that the surface of the cloth having the transferred image is fuzzy. In order to solve such a problem, Japanese Patent Application Laid-Open No. 10-16382 has proposed an image-transfer medium in the form of a sheet, comprising a base material, a releasing layer and a transfer layer, wherein a crosslinking agent is added into the transfer layer to crosslink and insolubilize a water-soluble resin used as a binder making up the transfer layer, thereby preventing dyes from running out upon washing or the like. However, even the use of this technique has not been able to achieve satisfactory fastness properties when a transfer-printing medium with a transferred image formed thereon using such an image-transfer medium is washed numerous times by means of a washing machine.

On the other hand, it is considered that, when the transfer layer is so constituted that a thermoplastic resin and a heat-crosslinking resin are contained in a transfer layer in advance, and first the thermoplastic resin in the transfer layer is melted at the time of transfer printing, to penetrate the melt into interstices in a transfer-printing medium and then the resin making up the transfer layer by the heat-crosslinking resin is crosslinked, or the crosslinking resin is allowed to be reacted with the transfer-printing medium, the transfer layer can be cured in a state firmly fixed to the transfer-printing medium, whereby the fall-off of the transfer layer by rubbing and the fuzzing at the surface of the cloth can be prevented to provide an image-transferred article having excellent fastness to washing. However, this constitution involves a problem that when the resulting image-transfer medium is stored for several days, the transferability of the medium is impaired during the storage to fail to transfer the transfer layer to a transfer-printing medium though the above excellent effect can be achieved right after the production of the image-transfer medium.

SUMMARY OF THE INVENTION

It is an object of the present invention to provide an image-transfer medium by which an image formed thereon making good use of an ink-jet printing method can be transferred to a transfer-printing medium such as a cloth to form a good transferred image, and particularly to provide an image-transfer medium for ink-jet printing, which has a high ink absorbency, permits the formation of an image high in optical density and clearness, can form a transferred image having high fastness to washing when the image is transferred to a transfer-printing medium and has excellent shelf stability in itself to always permit the simple and stable formation of a satisfactory transferred image on a transfer-printing medium such as a cloth, a production process of a transferred image having such properties as described above, and a cloth with a transferred image formed thereon.

The above object can be achieved by the present invention described below.

According to the present invention, there is thus provided an image-transfer medium for ink-jet printing, comprising a base material, and a releasing layer and a transfer layer, both provided on the base material, wherein the transfer layer comprises fine particles of a water-insoluble thermoplastic resin, a water-insoluble thermoplastic resin binder and a crosslinking agent coated with a thermoplastic resin.

According to the present invention, there is also provided an image-transfer recording medium for ink-jet printing, comprising a base material, a releasing layer and a transfer layer, both provided on the base material, wherein the transfer layer comprises fine particles of a water-insoluble thermoplastic resin, a water-insoluble thermoplastic resin binder and a crosslinking agent, and is constituted by at least two layers, namely, a layer containing the crosslinking agent and a layer containing no crosslinking agent, and the crosslinking agent-containing layer is substantially free of any material reactive to the crosslinking agent.

According to the present invention, there is further provided a process for producing a transferred image, comprising the steps of forming an image on the transfer layer of any of the image-transfer media for ink-jet printing described above in accordance with an ink-jet printing system; and transferring the transfer layer to the transfer-printing medium by overlapping the image-transfer medium, on which the image has been formed, with the transfer-printing medium.

According to the present invention, there is further provided a process for producing a transferred image, comprising the steps of transferring a layer, which contains a crosslinking agent and is substantially free of any material reactive to the crosslinking agent, to a transfer-printing medium; and transferring a layer containing a meterial reactive to the crosslinking agent to the transfer-printing medium.

According to the present invention, there is further provided a cloth with a transferred image formed thereon by any of the production processes described above.

DETAILED DESCRIPTION OF THE PREFERRED EMBODIMENTS

The image-transfer media for ink-jet printing according to the present invention include a releasing layer and a transfer layer, both provided on a base material, and the transfer layer comprises fine particles of a water insoluble thermoplastic resin, a water-insoluble thermoplastic resin binder and a crosslinking agent.

The action of the transfer layer of the image-transfer media for ink-jet printing according to the present invention having such constitution as described above will be first described.

The transfer layer of the image-transfer medium for ink-jet printing according to the present invention is porous because it is composed mainly of fine particles of a thermoplastic resin and a water-insoluble thermoplastic resin binder. As a result, when an image is formed on the transfer layer by an ink-jet printing system, inks can be satisfactorily absorbed and retained in the porous portion thereof, so that in the image-transfer medium according to the present invention, a satisfactory image can be formed on the transfer layer thereof by an ink-jet printing method.

In the image-transfer medium for ink-jet printing according to the present invention, a thermoplastic resin is used as a binder resin as a film-forming material for the transfer layer. Therefore, the transfer layer is easily fusion-bonded by heat. When the image-transfer medium for ink-jet printing according to the present invention is used, the transfer layer, on which the satisfactory image has been formed in the above-described manner, can be easily transferred to a transfer-printing medium by a heating and pressing means such as an iron.

Further, when the image-transfer medium for ink-jet printing according to the present invention is used to form a transferred image on a transfer-printing medium, there can be obtained a transferred image which is excellent in water-fastness, without dissolving the image in water even when it is wetted with water or sweat, since the resins used as film-forming materials in the transfer layer are insoluble in water. Therefore, the resultant transferred image comes to have excellent water fastness.

The transfer layer of the image-transfer medium for ink-jet printing according to the present invention comprises a crosslinking agent in addition to the fine particles of the water-insoluble thermoplastic resin and the water-insoluble thermoplastic resin binder. The thermoplastic resin binder and the fine particles of the thermoplastic resin making up the transfer layer are crosslinked by the action of the crosslinking agent by applying energy such as heat or light during transfer printing of an image formed on the transfer layer of a transfer-printing medium and/or after the transfer printing. As a result, the transferred image transfer-printed on the transfer-printing medium such as a cloth can be made firmer, so that the image quality of the transferred image is prevented from being deteriorated by its rubbing-off or the like even when the transfer-printing medium is washed repeatedly in a washing machine, whereby a cloth with the transferred image having high fastness properties formed thereon can be provided.

In the image-transfer medium for ink-jet printing according to the present invention, the crosslinking agent is added in a state in which it is coated with a thermoplastic resin having substantially no reactivity to the crosslinking agent. Therefore, the crosslinking agent comes into no contact with any material reactive to the crosslinking agent. The progress of a crosslinking reaction is thus effectively prevented even when the image-transfer medium is stored under, for example, environmental conditions of a high-temperature and high-humidity so far as the medium is stored without being subjected to heating or the like. As a result, the image-transfer medium is prevented from being deteriorated in transferability, which has heretofore been caused by the storage, so that a satisfactory transferred image can be stably formed.

The present invention will now be described in detail by referring to preferred embodiments of the image-transfer media according to the present invention. The individual components will hereinafter be described specifically.

First, the fine particles of the water-insoluble thermoplastic resin making up the transfer layer of each of the image-transfer media are only required to allow the transfer layer to have a function of satisfactorily absorbing and retaining inks by the presence of these fine particles in the transfer layer as described above, and moreover to have in themselves a function of melting by heating and easily adhering to a transfer-printing medium to form a transferred image when the transfer layer is transferred to the transfer-printing medium. More specifically, any fine particles may be used as the fine particles of the thermoplastic resin making up the transfer layer of the image-transfer medium according to the present invention so far as they are fine particles formed of a water-insoluble thermoplastic resin. When porous fine particles are used as the fine particles of the thermoplastic resin in this case, inks are absorbed in not only voids defined by the fine particles, but also pores in the fine particles, so that the ink absorbency of the transfer layer can be more enhanced to permit the formation of a higher-definition image.

Specific examples of materials for the fine particles of the thermoplastic resin used in the present invention include polyethylene, polypropylene, polyvinyl acetate, polyvinyl alcohol, polyvinyl acetal, poly(meth)acrylic acid, poly(meth)acrylates, polyacrylic acid derivatives, polyacrylamide, polyether, polyester, polycarbonate, cellulosic resins, polyacrylonitrile, polyimide, polyamide, polyvinyl chloride, polyvinylidene chloride, polystyrene, Thiokol, polysulfone, polyurethane and copolymers of these resins. Of these, polyethylene, polypropylene, poly(meth) acrylic acid, poly(meth)-acrylates, polyvinyl acetate, polyvinyl chloride, polyurethane, polyamide and copolymers thereof are more preferably used in the present invention.

In the image-transfer media for ink-jet printing according to the present invention, it is preferred to use fine particles of a thermoplastic resin composed of polyamide, particularly, a copolymer of nylon 6 and nylon 12 because the coloring ability of dyes becomes better, and so a clearer image can be provided.

The particle size of these fine particles used in the present invention is preferably within a range of from 0.05 to 100 $\mu$m, more preferably from 0.2 to 50 $\mu$m, most preferably from 5 to 20 $\mu$m from the viewpoints of the ink absorbency of the resulting transfer layer and the clearness of the resulting image. If the particle size of the fine particles of the thermoplastic resin is smaller than 0.05 $\mu$m, interparticle voids become too small when a transfer layer is formed from such fine particles, and so the transfer layer is unlikely to have sufficient ink absorbency. Further, if the particles are too small, the smoothness of the surface of the resulting transfer layer becomes too high, so that the transfer layer becomes unlikely to penetrate into fibers of a cloth when transferred to the cloth, and a transferred image tends to be formed as an even continuous film on the surface of the cloth. As a result, any satisfactory transferred image may not be provided in some cases because the transferred image becomes easy to be separated from the cloth, and the transfer layer cracks to expose the underlying fibers when the cloth is stretched. If the particle size is greater than 100 $\mu$m, on the other hand, the resolution of the resulting image becomes low, so that no clear image can be provided.

As to the fine particles of the thermoplastic resin used in the present invention, porous fine particles may preferably be used as described above. When the porous fine particles are used in the transfer layer, the ink absorbency of the transfer layer can be enhanced, so that a greater amount of inks can be absorbed in a thinner layer. Further, the provision of the thinner transfer layer not only permits transferring the resulting image with more ease, but also provides a more preferable transfer-printed cloth in a soft hand without impairing the hand of a transfer-printing medium at the transfer-printed portion thereof when a flexible material such as a cloth is used as the transfer-printing medium, in particular when a transferred image is formed on surface of the cloth.

As to the fine particles of the thermoplastic resin used in the present invention, it is more preferable to use those formed of a material which permits forming an image on the resulting transfer layer by means of a general-purpose ink-jet printer and then simply transferring the image in a home or the like. Taking this regard into consideration, the thermoplastic resin used preferably has a melting point ranging from 70° C. to 200° C., more preferably from 80° C. to 180° C., most preferably from 100° C. to 150° C. When a thermoplastic resin having a melting point lower than 70° C. is used, the fine particles of the thermoplastic resin in the resulting transfer layer may possibly be melted to form a continuous film according to conditions where the resulting image-transfer medium is shipped or stored. After coating the base material with the fine particles of the thermoplastic resin, it is necessary to dry the coating layer at a temperature lower than the melting point of the fine particles of the thermoplastic resin. It is thus preferable to use the thermoplastic resin having a melting point of at least 70° C. even from the viewpoint of production efficiency. On the other hand, if a resin having a melting point higher than 200° C. is used, higher energy is required for transfer-printing an image formed on the resulting transfer layer onto a transfer-printing medium. It is hence difficult to simply form a transferred image on the transfer-printing medium such as a cloth, which is an object of the present invention.

When a cloth is used as a transfer-printing medium in the present invention, it is preferable to use a resin having a low melt viscosity taking the adhesion of the resulting transfer layer to the cloth into consideration. More specifically, when a resin having a high melt viscosity is used, the adhesion between the resulting transfer layer and the cloth becomes poor, so that the transfer layer formed into a continuous film on the cloth becomes easy to be separated from the cloth. On the other hand, when the material having a low melt viscosity is used, the resulting transfer layer becomes easy to penetrate into fibers of the cloth upon transfer printing, thereby providing a good transferred image without exposing the color of the underlying fibers even when the cloth is stretched after the transfer printing.

In order not to impair hand of the cloth as much as possible after transfer printing, it is preferable to use a material capable of forming a film having high flexibility.

Second, the water-insoluble thermoplastic resin binder making up the transfer layer of the image-transfer medium for ink-jet printing according to the present invention will be described. The binder is added for purposes of bonding the fine particles of the thermoplastic resin to one another to form the transfer layer and of bonding the transfer layer, on which an image has been formed, to a transfer-printing medium such as a cloth upon transfer printing. As with the fine particles of the thermoplastic resin, a water-insoluble thermoplastic resin is used for the binder in the present invention. Specifically, those mentioned above as the materials for the fine particles of the thermoplastic resin may be used.

In the present invention, the weight ratio of the fine particles of the thermoplastic resin to the thermoplastic resin binder is preferably within a range of from 1/2 to 50/1, more preferably from 1/2 to 20/1, most preferably from 1/2 to 15/1. If the proportion of the fine particles of the thermoplastic resin is too high, adhesion among the fine particles of the thermoplastic resin or between the fine particles of the thermoplastic resin and the releasing layer becomes insufficient, which makes it impossible to form a transfer layer having sufficient strength. On the other hand, if the proportion of the fine particles of the thermoplastic resin is too low, it is difficult to provide a transfer layer having excellent ink absorbency and permitting the formation of an image having excellent clearness thereon.

In the image-transfer media for ink-jet printing according to the present invention, a firm or strong transfer layer is formed by crosslinking the fine particles of the thermoplastic resin and/or the thermoplastic resin binder with a crosslinking agent coexisting therewith in the transfer layer. Accordingly, it is desirable that at least one of the fine particles of the thermoplastic resin and the thermoplastic resin binder should contain a substance reactive to the crosslinking agent, which will be described subsequently.

Third, the crosslinking agent making up the transfer layer according to the present invention will be described.

In the image-transfer media for ink-jet printing according to the present invention, the crosslinking agent is added in a state that it is coated with a thermoplastic resin having substantially no reactivity to the crosslinking agent. Therefore, the crosslinking agent can avoid coming into contact with any material reactive to the crosslinking agent, thereby preventing the deterioration of transferability by storage of the resulting image-transfer medium, since a crosslinking reaction does not occur before transfer printing. On the other hand, since the thermoplastic resin coating the crosslinking agent is melted by heat applied upon transfer printing, the interior crosslinking agent is exposed and comes into contact with the fine particles of the thermoplastic resin and the thermoplastic resin binder, which are contained in the transfer layer and reactive to the crosslinking agent. When energy such as heat or light is applied to the crosslinking agent in this state during transfer printing or after the transfer printing, a crosslinking reaction takes place to form a firmer transfer layer.

Any conventionally-known crosslinking agent may be used as the crosslinking agent useful in the practice of the present invention so far as it can crosslink the fine particles of the thermoplastic resin or the thermoplastic resin binder in the transfer layer.

Specific examples of crosslinking agents to be reacted by heat include sulfur, sulfur homologues, organic peroxides, phenol resins, amino resins, quinone, quinone dioxime derivatives, halogen compounds, amines, aziridine compounds, azo compounds, isocyanate compounds, carboxylic acids, acid anhydrides, aldehydes, alcohols, epoxy compounds, boranes, metal oxides, metal peroxides, metal sulfides, metal halides, organic metal halides, organic acid metal salts, metal alkoxides, organometallic compounds and silane compounds.

Examples of crosslinking agent to be reacted by light, electron rays and the like include compounds having an acryloyl group, diazo group, dithiocarbamate group or the like.

Any thermoplastic resin may be used as the resin for coating these crosslinking agents so far as it has no reactivity to the crosslinking agents to be coated therewith. Specifically, it may be suitably selected for use from among the thermoplastic resins mentioned above as the materials for the fine particles of the thermoplastic resin according to the crosslinking agent to be coated.

More preferably, a crosslinked structure capable of forming a transferred image having far excellent fastness properties can be formed by selecting a thermoplastic resin and a crosslinking agent in the following combination.

When a resin containing a carboxyl group is crosslinked, for example, a phenol resin, amino resin, amine, aziridine compound, epoxy compound, isocyanate compound or metal oxide is preferably used as the crosslinking agent. When a resin containing a hydroxyl group is crosslinked, for example, a phenol resin, amino resin, halogen compound, amine, aziridine compound, isocyanate compound, acid anhydride, aldehyde or epoxy compound is preferably used as the crosslinking agent. When a resin containing an isocyanate group is crosslinked, for example, an amine, isocyanate compound acid anhydride, alcohol or epoxy compound is preferably used as the crosslinking agent.

In the present invention, it is preferred that a catalyst be added in addition to these crosslinking agents, since the crosslinking reaction can be allowed to more rapidly progress to shorten transfer printing time.

As described above, when the thermoplastic resin coating the crosslinking agent of such constitution as described above is melted by heat energy applied to the transfer layer during transfer printing or after the transfer printing, the interior crosslinking agent comes into contact with the fine particles of the thermoplastic resin and/or the thermoplastic resin binder in the transfer layer, whereby the crosslinking agent reacts with these resins to form a crosslinked structure. Therefore, the thermoplastic resin used for coating the crosslinking agent is preferably melted with ease by heat applied by a household iron or the like. Namely, the thermoplastic resin used in this case preferably has a melting point ranging from 70° C. to 200° C., more preferably from 80° C. to 180° C., most preferably from 100° C. to 150° C.

In order to obtain optimum reactivity to the resins, the crosslinking agent used in the present invention coated with such a thermoplastic resin as described above preferably has a particle size of the order of 0.05 to 100 $\mu$m though it varies according to the kind of the crosslinking agent used.

The crosslinking agent coated with such a thermoplastic resin as described above can be prepared by the same method as a general preparation method of microcapsules. Examples of the general preparation method of microcapsules include chemical preparation methods, physical preparation methods and physical-mechanical preparation methods. Examples of the chemical preparation methods used in the present invention include an interfacial polymerization method, in-situ polymerization method and in-liquid curing and coating method (orifice method). Examples of physical preparation methods include a coacervation method, interfacial precipitation method (in-liquid concentration method, in-liquid drying method, or secondary elution method), melt dispersion method, inner-material exchange method and powder compression method. Examples of the physical-mechanical preparation methods include a spray drying method, in-air suspension coating method, vacuum deposition coating method, mineral wall encapsulating method, electrostatic coalescence method and high-speed flow impact method.

In an image-transfer medium according to a more preferred embodiment of the present invention, the transfer layer is composed of at least two layers of a layer containing the crosslinking agent and a layer containing no crosslinking agent, and the crosslinking agent-containing layer is formed in such a manner that any material reactive to such a crosslinking agent as described above is substantially not contained. This layer structure permits the sure separation of the crosslinking agent from components reactive to the crosslinking agent, thereby achieving higher shelf stability in the resulting image-transfer medium.

When the transfer layer is formed from at least two layers of a layer containing the crosslinking agent and a layer containing no crosslinking agent as described above, and the crosslinking agent-containing layer is formed in such a manner that any material reactive to the crosslinking agent is substantially not contained, the crosslinking agent may not be coated with the thermoplastic resin.

The transfer layer formed of at least two layers will hereinafter be described in detail.

A surface layer (layer on the side farther from the base material) of the transfer layer is preferably composed of a porous layer containing the fine particles of the thermoplastic resin for the purpose of satisfactorily absorbing inks to form a better image. In this case, it is preferable to use a binder for bonding these fine particles to one another to form the porous layer.

Preferable constitutional examples of the transfer layer of a multi-layer structure include the following structures (1) to (4). Incidentally, the individual layers of the transfer layer are referred to as the first layer, second layer, third layer . . . n-th layer in order from the side farther from the base material.

Constitutional Example (1)

| | |
|---|---|
| First layer: | fine particles of a thermoplastic resin reactive to a crosslinking agent, and a thermoplastic resin binder reactive to the crosslinking agent; |
| Second layer: | crosslinking agent. |

Constitutional Example (2)

| | |
|---|---|
| First layer: | fine particles of a thermoplastic resin having no reactivity to a crosslinking agent, a thermoplastic resin binder having no reactivity to the crosslinking agent, and the crosslinking agent; |
| Second layer: | thermoplastic resin reactive to the cross linking agent. |

Constitutional Example (3)

| | |
|---|---|
| First layer: | thermoplastic resin containing a crosslinking agent component, and a thermoplastic resin binder having no reactivity to the crosslinking agent; |
| Second layer: | fine particles of a thermoplastic resin reactive to the crosslinking agent. |

Constitutional Example (4)

| | |
|---|---|
| First layer: | fine particles of a thermoplastic resin reactive to a crosslinking agent, and a thermoplastic resin binder reactive to the crosslinking agent; |
| Second layer: | thermoplastic resin having no reactivity to the crosslinking agent; |
| Third layer: | crosslinking agent. |

When a layer of a resin having no reactivity to the crosslinking agent, preferably, a uniform film layer formed of such a resin, is provided between a crosslinking agent-containing layer (third layer) and a layer (first layer) containing materials reactive to the crosslinking agent like Constitutional Example (4), the crosslinking agent can be completely separated from the materials reactive to the crosslinking agent. As a result, the progress of a crosslinking reaction during storage of the resulting image-transfer medium can be completely prevented. It is thus preferred to provide such an intermediate layer because the transferability of the image-transfer medium is not impaired even when it is stored.

In Constitutional Examples (1) to (4) described above, the crosslinking agent and materials reactive to the crosslinking agent are added to separate layers, respectively. Namely, in the present invention, it is not preferred to use a crosslinking agent which self-crosslinks in itself.

The crosslinking agents used in Constitutional Examples (1) to (4) are preferably solid at room temperature, more preferably have a melting point of at least 70° C. More specifically, when a crosslinking agent which is liquid at room temperature is used, there is a possibility that even when the transfer layer is formed from a layer containing the crosslinking agent and another layer containing the components reactive to the crosslinking agent, the crosslinking agent may migrate during storage of the resulting image-transfer medium to react with the reactive components. When the crosslinking agent has a melting point lower than 70° C., even if it is solid at ordinary temperature, there is also a possibility that the crosslinking agent may become liquid according to conditions where the resulting image-transfer medium is shipped or stored to cause the same phenomenon.

In the present invention, it is more preferable to use a crosslinking agent developing reactivity by heat, since a crosslinking reaction can be conducted making good use of heat upon transfer printing.

As a method for separating a crosslinking agent from materials reactive to the crosslinking agent, it is considered to separately form two transfer layers in the form of a sheet using the respective materials to lay one on top of another upon transfer printing, thereby transferring them. Namely, an image-transfer medium a provided with a transfer layer, which contains a crosslinking agent and is free of any material reactive to the crosslinking agent, on a base material, and an image-transfer medium b provided with a transfer layer, which contains material(s) reactive to the crosslinking agent used in the image-transfer medium a, on a base material, are separately produced. More specifically, it is preferable to form an image-transfer medium a provided with a transfer layer having the same constitution as the first layer in each of the above-described Constitutional Examples (1) to (3) in which the transfer layer is composed of two layers, and an image-transfer medium b provided with a transfer layer having the same constitution as the second layer. When the two image-transfer media thus produced are used, an image is first formed on the image-transfer medium a by an ink-jet system, the transfer layer of one image-transfer medium is transferred, and the other image-transfer medium is then laid on the first transferred transfer layer to transfer the transfer layer thereof. In this case, no particular limitation is imposed on the transferring order, and either the image-transfer medium a or the image-transfer medium b may be used first.

When the transfer layer is composed of at least two layers as described above, it is preferred that a layer adjacent to the releasing layer be formed of a uniform film containing no fine particle of the thermoplastic resin. In particular, the film is preferably a non-porous uniform film. The formation of the uniform film layer has the following two advantages. First, the transfer layer can be formed with more easy. More specifically, in the image-transfer medium for ink-jet printing according to the present invention, the porous transfer layer having good ink absorbency is provided on the releasing layer. When the porous layer is provided directly on a layer having low adhesion, such as the releasing layer, the adhesion between these layers becomes poor, so that in some cases, the transfer layer may be separated from the releasing layer upon handling of the resulting image-transfer medium.

On the other hand, when a transfer layer is provided as a layer of a two-layer structure in such a manner that the uniform film layer is situated on the side of the releasing layer, the adhesion between the transfer layer and the releasing layer can be improved, and so the above problem becomes hard to arise.

Second, the fastness to washing of a transferred image can be more improved. More specifically, when the transfer layer is provided as a layer of the two-layer structure, the transfer layer adjacent to the releasing layer comes to form a face of the transferred image when the transfer layer, on which an image has been formed, is transferred to a transfer-printing medium such as a cloth, so that the uniform film layer comes to cover the surface of the transferred image. Therefore, it is considered that the coloring materials forming the image are closely fixed to the cloth in a state that they are more reliably shielded, and the fastness properties of the transferred image are hence enhanced.

In the above case, it is more preferred that the same thermoplastic resins be used in the uniform film layer and the porous layer containing the fine particles of the thermoplastic resin for absorbing and retaining inks. More specifically, when the same materials are used as materials for forming these two layers, adhesion between the two layers can be enhanced, and so the fastness properties of the transferred image can be more improved. Further, since a difference in refractive index between the two layers becomes small, the transfer layer after transfer printing becomes transparent, and so a clear transferred image can be provided.

The essential components for forming the transfer layer of each of the image-transfer media for ink-jet printing according to the present invention have been described above. In the present invention, other additives may be added in addition to the essential components.

For example, when inorganic fine particles are added into the transfer layer, the ink absorbency of the transfer layer can be improved to form a clearer image thereon. In addition, the addition of the inorganic fine particles into the transfer layer can prevent the thermoplastic resin making up the transfer layer from penetrating into a transfer-printing medium such as a cloth in excess upon transfer of the transfer layer to the transfer-printing medium, so that a film of the transfer layer can be formed on the surface of the cloth to form a clear transferred image having a high optical density.

No particular limitation is imposed on the inorganic fine particles used in the present invention so far as they are inorganic particles having no melt property under heat and a white color. Specific examples thereof include silica, aluminum silicate, magnesium silicate, hydrotalcite, calcium carbonate, titanium oxide, clay, talc and (basic) magnesium carbonate. Of these, a material having high dyeing property may preferably be used, since a dye in an ink is better fixed to the surface of a transfer-printing medium such as a cloth.

When a material having a higher void volume is used from among the inorganic particles, the ink absorbency of the resulting transfer layer is also enhanced, and so a clearer image can be provided. The particle size of the inorganic particles used in the present invention is preferably equal to that of the fine particles of the thermoplastic resin described above as much as possible. The reason for it is that when particles different in particle size are added to each other, particles having a smaller diameter are filled in interparticle voids of particles having a greater diameter, so that the void volume of the resulting transfer layer is reduced.

The addition of a cationic material to the transfer layer permits the achievement of higher fastness to washing. More specifically, coloring materials commonly used in inks used in ink-jet printers are water-soluble anionic dyes. Such a coloring material is taken together into the transfer layer at the time the fine particles of the thermoplastic resin are melted by heat upon transfer printing, and fixed in the form of a film to a transfer-printing medium such as a cloth. However, the film thus formed may not become completely even in some case. In such a case, the dye may exude when the cloth transfer-printed is immersed in water. When the cationic material is added to the transfer layer, however, the dye can be insolubilized to prevent the dye from being dissolved out.

Specific examples of the cationic material used in this case include the following materials:

- cationically modified products of resins such as polyvinyl alcohol, hydroxyethyl cellulose and polyvinyl pyrrolidone;
- polymers and copolymers of amine monomers such as allylamine, diallylamine, allyl sulfone, dimethylallyl sulfone and diallyldimethylammonium chloride, and of acrylic monomers having a primary, secondary or tertiary amine, or quaternary ammonium base at their side chains, such as dimethylaminoethyl (meth)acrylate, diethyl-aminoethyl (meth)acrylate, methylethylaminoethyl (meth)acrylate, dimethylaminostyrene, diethylaminostyrene, methylethylaminostyrene, N-methylacrylamide, N,N-dimethyl-acrylamide, N,N-diethylaminoethyl methacrylamide and quaternized compounds thereof; and
- resins having a primary, secondary or tertiary amine, or quaternary ammonium base, such as dicyanamide, at their main chains.

Further, it is effective to add a plasticizer for the fine particles of the thermoplastic resin or the thermoplastic resin, binder into the transfer layer from the viewpoint of enhancing transferability. By adding the plasticizer, the melt viscosity of the transfer layer becomes low upon its transfer, i.e., its heating, so that its adhesion to a transfer-printing medium such as a cloth can be more enhanced, and the transferability is improved. As the plasticizer used in this case, any conventionally-known plasticizer may be used. Specific examples thereof include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, chlorinated paraffins, toluenesulfonamide and derivatives thereof, and 2-ethylhexyl p-hydroxybenzoate.

A surfactant may also be added into the transfer layer for the purpose of improving the permeability of the transfer layer to inks. More specifically, when the surfactant is added into the transfer layer, the wettability of the surfaces of the particles contained in the transfer layer is improved, and so the penetrability of water-based inks into the transfer layer is enhanced when an image is formed by an ink-jet printing system. As the surfactant used in this case, may be used any of nonionic surfactants commonly used. More specifically, surfactants of the ether, ester, ether-ester and fluorine-containing types may be used.

The layer thickness of the thus-formed transfer layer of each of the image-transfer media for ink-jet printing according to the present invention is preferably within a range of from 15 to 250 μm, more preferably from 40 to 200 μm, most preferably from 50 to 150 μm. The layer thickness of the portion of the transfer layer having voids for absorbing and retaining inks, on which an image can be formed by ink-jet printing, is preferably within a range of from 10 to 150 μm, more preferably from 30 to 120 μm, most preferably from 40 to 100 μm. If the transfer layer of the image-transfer medium is too thick, the flexibility of a flexible transfer-printing medium such as a cloth is deteriorated at its portion on which the transfer layer has been transferred by transfer printing, so that hand of this portion becomes poor. If the transfer layer is too thin on the other hand, the strength of the transfer layer becomes weak, which forms the cause that the fastness to washing, and the like of the resulting transferred image are deteriorated. Further, if the portion having the voids for absorbing and retaining inks is too thin, it is difficult to form any high-definition image because inks are not sufficiently absorbed and retained therein.

The image-transfer media for ink-jet printing according to the present invention have a releasing layer together with the transfer layer of such a constitution as described above. The presence of the releasing layer allows to efficiently and easily transfer the transfer layer having the excellent properties described above to a transfer-printing medium such as a cloth to form a transferred image. When the transfer layer, on which an image has been formed, is transferred to a cloth, and the base material carrying the transfer layer is then separated and removed from the cloth, for example, a problem that the transfer layer transferred is separated from the cloth together with the base material, or a part of the transfer layer remains on the base material without being transferred, and so the image is impaired can be effectively prevented.

Examples of a material used for such a releasing layer first include, as hot-melt materials, waxes such as carnauba wax, paraffin wax, microcrystalline wax and castor wax; higher fatty acids and derivatives thereof such as metal salts and esters, for example, stearic acid, palmitic acid, lauric acid, aluminum stearate, lead stearate, barium stearate, zinc stearate, zinc palmitate, methyl hydroxystearate and glycerol monohydroxystearate; polyamide resins; petroleum resins; rosin derivatives; coumarone-indene resins; terpene resins; novolak resins; styrene resins; olefin resins such as polyethylene, polypropylene, polybutene and polyolefin oxides; and vinyl ether resins. Besides, silicone resins, fluorosilicone resins, fluoroolefin-vinyl ether terpolymers, perfluoroepoxy resins, thermosetting acrylic resins having perfluoroalkyl groups at their side chains, and vinylidene fluoride type hardening resins may also be used.

As the base material used in the image-transfer media for ink-jet printing according to the present invention, on which such releasing layer and transfer layer as described above are supported, any base material may be used so far as it can be conveyed in printers and has heat resistance necessary for thermal transfer printing. Specific examples thereof include films of synthetic resins such as polyester, diacetate resins, triacetate resins, acrylic polymers, polycarbonate, polyvinyl chloride, polyimide, cellophane and celluloid, paper, and flexible base materials such as fabrics and nonwoven fabrics. In the image-transfer media for ink-jet printing according to the present invention, it is particularly preferred to use a flexible base material because even when the surface of a transfer-printing medium to be transfer-printed is curved, the transfer layer of each image-transfer medium can be transferred along the shape of the transfer-printing medium, so that a transferred image can also be satisfactorily formed even on any transfer-printing media other than flat media.

No particular limitation is imposed on the thickness of the base material. However, it is preferably within limits conveyable in a general-purpose ink-jet printer. For example, a base material having a thickness of from 30 to 200 μm may preferably be used.

No particular limitation is also imposed on the processes for forming the releasing layer and the transfer layer on the base material. However, examples thereof include a process in which suitable materials for forming the transfer layer are dissolved or dispersed in a proper solvent to prepare a coating formulation, and the coating formulation is applied to a base material by coating or the like, a process in which a film is formed from suitable materials for forming the transfer layer, and the film is laminated on a base material, and a process in which the suitable materials are extruded in the form of a film on a base material. Examples of a coating method of the coating formulation include roll coater, blade coater, air knife coater, gate roll coater, bar coater, size pressing, Symsizer, spray coating, gravure coating and curtain coater methods.

The image-transfer media for ink-jet printing according to the present invention produced by the above-described process can be applied to the production process of a transferred image according to the present invention, which comprises the steps of forming an image on the transfer layer of an image-transfer medium for ink-jet printing in accordance with an ink-jet printing system; and transferring the transfer layer to the transfer-printing medium, by overlapping the image-transfer medium, on which the image has been formed, on a transfer-printing medium each other.

More specifically, an image is first formed on the transfer layer of the image-transfer medium according to the present invention by an ink-jet printing system. The image-transfer medium, on which the image has been formed, and a transfer-printing medium such as a cloth or film are then laid to overlap each other with the transfer layer on the side of the transfer-printing medium to heat them from the side opposite to the transfer layer of the image-transfer medium, thereby transferring the transfer layer to the transfer-printing medium. Finally, the base material is separated from the transfer-printing medium to form a transferred image on the transfer-printing medium such as the cloth. As an ink-jet printer used in this case, any commercially available ink-jet printer may be employed as it is. No particular limitation is also imposed on coloring materials constituting inks used in the image-forming step. For example, conventionally known anionic coloring materials may be used.

In the production process of a transferred image according to the present invention, as described above, an image is formed on the transfer layer, and the image is transferred to a transfer-printing medium such as a cloth to form the transferred image. Therefore, this process is different from a process of directly printing an image on a cloth to form the image. It is thus unnecessary to specially change coloring materials according to the kinds of fiber materials or the like making up transfer-printing media. Accordingly, when a cloth is used as the transfer-printing medium to form a transferred image on the cloth in accordance with the production process of a transferred image as described above, a cloth with a satisfactory transferred image formed thereon can be provided by a simple process. No particular limitation is also imposed on the cloth used in forming the transferred image in the present invention. Examples of the material making up the cloth include cotton, hemp, silk, wool, rayon, polyester, nylon, acrylic fiber, acetate fiber, triacetate fiber and polyurethane, and blended fibers thereof. The cloths made up of these materials may be used in any forms of a woven fabric, a knitted fabric and a nonwoven fabric.

The present invention will hereinafter be described more specifically by the following Examples and Comparative Examples. Incidentally, all designations of "part" or "parts" and "%" as will be used in the following examples mean part or parts by weight and % by weight unless expressly noted.

The following materials were used to prepare microcapsules a and b incorporated with a crosslinking agent used in the following Examples, in which the surface of a crosslinking agent was coated with a thermoplastic resin having no reactivity to the crosslinking agent.

(Microcapsule a)

Core material:

Epoxy type crosslinking agent (Epiclon 3050, trade name, product of Dainippon Ink & Chemicals, Incorporated);

Shell material:

(Polyethylene A-C6, trade name, product of Allied Signal Co.);

Amount encapsulated: 70%:

Average particle size: 10 μm.

(Microcapsule b)

Core material:

Epoxy type crosslinking agent (Denacol EM-150, trade name, product of Nagase Chemicals, Ltd.);

Shell material:

(Polyethylene A-C6, trade name, product of Allied Signal Co.);

Amount encapsulated: 70%;

Average particle size: 15 μm.

Other materials used in the Examples and Comparative Examples are described below.

(Microcapsule c): (Matsumoto Microsphere EP-28, trade name, product of Matsumoto Yushi-Seiyaku Co., Ltd.)

Core material:

Bisphenol A type epoxy resin;

Shell material:

Formalin polycondensation type resin (this resin is a thermosetting resin);

Amount encapsulated: about 70%;

Average particle size: 20 to 60 μm.

Fine particles of thermoplastic resin:

(Fine Particle a of Thermoplastic Resin)

Fine particles of an ethylene resin (AC Polyethy A-6, trade name, product of Allied Signal Co., particle size: 6 μm);

(Fine Particle b of Thermoplastic Resin)

Porous fine particles of a nylon resin (Orgasol 3501EDX NAT, trade name, product of Elf Atochem S.A., particle size: 10 μm).

Binder resin:

(Thermoplastic Resin Binder a)

Ethylene-acrylic acid copolymer emulsion (Hytec E-8778, trade name, product of Toho Chemical Industry Co., Ltd., solid content: 25%);

(Thermoplastic Resin Binder b)

Urethane polymer emulsion (Takelac W-635c, trade name, product of Takeda Chemical Industries, Ltd., solid content: 35%);

(Thermoplastic Resin Binder c)

Ethylene-vinyl acetate copolymer emulsion (Chemipearl V-300, trade name, product of Mitsui Petrochemical Industries, Ltd., particle size: 6 μm, solid content: 40%);

(Water-soluble Resin Binder a)

Polyvinyl alcohol (PVA-217, trade name, product of Kuraray Co., Ltd., used in the form of a 20% aqueous solution).

Crosslinking agent:

(Crosslinking Agent a)

Epoxy type crosslinking agent (Denacol EX-810, trade name, product of Nagase Chemicals, Ltd., melting point: 60° C., solid content: 50%);

(Crosslinking Agent b)

Epoxy type crosslinking agent (Denacol EM-150, trade name, product of Nagase Chemicals, Ltd., melting point: 60° C., solid content: 50%);

(Crosslinking Agent c)

Metal oxide type crosslinking agent (zinc oxide, melting point: 2,000° C., used in the form of a 10% solution in diluted acetic acid);

(Crosslinking Agent d)

Epoxy type crosslinking agent (EP-1005, trade name, product of Toho Chemical Industry Co., Ltd., melting point: 120° C., solid content: 50%).

Various additives:

(Inorganic Fine Particle a)

Silica (Mizukasil P-78A, trade name, product of Mizusawa industrial Chemicals, Ltd., particle size: 3 μm);

(Cationic Resin a)

Acrylic cationic resin (EL Polymer NWS-16, trade name, product of Shin-Nakamura Chemical Co., Ltd.; solid content: 30%);

(Plasticizer a)

N-Ethyl-o,p-toluenesulfonamide (Topcizer No. 3, trade name, product of Fuji Amide Chemical Co., Ltd.);

(Surfactant a)

Fluorine-containing surfactant (Surflon S-131, trade name, product of Seimi Chemical Co., Ltd.; solid content: 30%).

Base material:

(Base Material a Provided with a Releasing Layer)

Release paper (having a release layer formed of a silicone resin; ST60 OKT-T, trade name, product of Lintec Corporation)

Of these, proper materials were used to prepare coating formulations of their corresponding compositions shown below. Each of the thus-prepared coating formulation was then applied to the base material a, on which a release layer had been provided, by means of a bar coater and dried under the following conditions to form a transfer layer, thereby obtaining respective image-transfer media according to Examples and Comparative Examples each having the releasing layer and transfer layer. The coating was conducted in the order of the third layer, the second layer and then the first layer in the case of a 3-layer structure, or of the second layer and then the first layer in the case of a 2-layer structure. The constitution of the transfer layers of the image-transfer media according to Examples 1 to 10 and Comparative Examples 1 to 11 are shown collectively in the following tables.

EXAMPLE 1

| <Composition of coating formulation> | |
|---|---|
| Fine particle a of thermoplastic resin | 100 parts |
| Thermoplastic resin binder a | 40 parts (solid content: 10 parts) |
| Microcapsule a | 10 parts |

-continued

| | |
|---|---|
| Inorganic fine particle a | 2 parts |
| Cationic resin a | 10 parts (solid content: 3 parts) |
| Surfactant a | 3 parts (solid content: 1 part) |
| Water | 10 parts. |
| (Coating conditions) | |
| Drying conditions: | 70° C./10 min. |
| Coating thickness: | 70 μm. |

EXAMPLE 2

| | |
|---|---|
| <Composition of coating formulation> | |
| Fine particle a of thermoplastic resin | 100 parts |
| Thermoplastic resin binder a | 40 parts (solid content: 10 parts) |
| Microcapsule b | 10 parts |
| Inorganic fine particle a | 2 parts |
| Cationic resin a | 10 parts (solid content: 3 parts) |
| Surfactant a | 3 parts (solid content: 1 part) |
| Water | 10 parts. |
| (Coating conditions) | |
| Drying conditions: | 70° C./10 min. |
| Coating thickness: | 70 μm. |

EXAMPLE 3

| | |
|---|---|
| <Composition of coating formulation> | |
| Fine particle b of thermoplastic resin | 100 parts |
| Thermoplastic resin binder a | 360 parts (solid content: 90 parts) |
| Thermoplastic resin binder b | 30 parts (solid content: 10 parts) |
| Microcapsule b | 50 parts |
| Plasticizer a | 20 parts |
| Cationic resin a | 20 parts (solid content: 6 parts) |
| Surfactant a | 6 parts (solid content: 2 parts) |
| Isopropyl alcohol (IPA) | 300 parts. |
| (Coating conditions) | |
| Drying conditions: | 70° C./10 min. |
| Coating thickness: | 80 μm. |

EXAMPLE 4

| | |
|---|---|
| <Composition of coating formulation for first layer of transfer layer> | |
| Fine particle b of thermoplastic resin | 100 parts |
| Thermoplastic resin binder a | 360 parts (solid content: 90 parts) |
| Thermoplastic resin binder b | 30 parts (solid content: 10 parts) |
| Plasticizer a | 20 parts |
| Cationic resin a | 20 parts (solid content: 6 parts) |
| Surfactant a | 6 parts (solid content: 2 parts) |
| Isopropyl alcohol (IPA) | 300 parts. |
| (Coating conditions) | |
| Drying conditions: | 70° C./10 min. |
| Coating thickness: | 80 μm. |
| <Composition of coating formulation for second layer of transfer layer> | |
| Microcapsule b | 50 parts |
| Thermoplastic resin binder c | 50 parts (solid content: 50 parts). |
| (Coating conditions) | |
| Drying conditions: | 70° C./5 min. |
| Coating thickness: | 20 μm. |

Comparative Example 1

| | |
|---|---|
| <Composition of coating formulation> | |
| Fine particla a of thermoplastic resin | 100 parts |
| Thermoplastic resin binder a | 40 parts (solid content: 10 parts) |
| Inorganic fine particle a | 2 parts |
| Cationic resin a | 10 parts (solid content: 3 parts) |
| Surfactant a | 3 parts (solid content: 1 part). |
| (Coating conditions) | |
| Drying conditions: | 70° C./10 min. |
| Coating thickness: | 90 μm. |

Comparative Example 2

| | |
|---|---|
| <Composition of coating formulation> | |
| Fine particle a of thermoplastic resin | 100 parts |
| Thermoplastic resin binder a | 40 parts (solid content: 10 parts) |
| Crosslinking agent a | 5 parts |
| Inorganic fine particle a | 2 parts |
| Cationic resin a | 10 parts (solid content: 3 parts) |
| Surfactant a | 3 parts (solid content: 1 part). |
| (Coating conditions) | |
| Drying conditions: | 70° C./10 min. |
| Coating thickness: | 90 μm. |

Comparative Example 3

| | |
|---|---|
| <Composition of coating formulation> | |
| Fine particle b of thermoplastic resin | 100 parts |
| Thermoplastic resin binder a | 360 parts (solid content: 90 parts) |
| Thermoplastic resin binder b | 30 parts (solid content: 10 parts) |
| Plasticizer a | 20 parts |
| Cationic resin a | 20 parts (solid content: 6 parts) |
| Surfactant a | 6 parts |

-continued

| | |
|---|---|
| | (solid content: 2 parts) |
| Isopropyl aLcohol (IPA) | 300 parts. |
| (Coating conditions) | |
| Drying conditions: | 70° C./10 min. |
| Coating thickness: | 90 μm. |

Comparative Example 4

| <Composition of coating formulation> | |
|---|---|
| Fine particle b of thermoplastic resin | 100 parts |
| Thermoplastic resin binder a | 360 parts |
| | (solid content: 90 parts) |
| Thermoplastic resin binder b | 30 parts |
| | (solid content: 10 parts) |
| Crosslinking agent a | 10 parts |
| Plasticizer a | 20 parts |
| Cationic resin a | 20 parts |
| | (solid content: 6 parts) |
| Surfactant a | 6 parts |
| | (solid content: 2 parts) |
| Isopropyl alcohol (IPA) | 300 parts. |
| (Coating conditions) | |
| Drying conditions: | 70° C./10 min. |
| Coating thickness: | 80 μm. |

Comparative Example 5

| <Composition of coating formulation> | |
|---|---|
| Fine particle b of thermoplastic resin | 100 parts |
| Thermoplastic resin binder a | 360 parts |
| | (solid content: 90 parts) |
| Thermoplastic resin binder b | 30 parts |
| | (solid content: 10 parts) |
| Microcapsule c | 50 parts |
| Cationic resin a | 20 parts |
| | (solid content: 6 parts) |
| Surfactant a | 6 parts |
| | (solid content: 2 parts) |
| Isopropyl alcohol (IPA) | 300 parts. |
| (Coating conditions) | |
| Drying conditions: | 70° C./10 min. |
| Coating thickness: | 80 μm. |

Comparative Example 6

| <Composition of coating formulation> | |
|---|---|
| Fine particle a of thermoplastic resin | 100 parts |
| Water-soluble resin binder a | 50 parts |
| | (solid content: 10 parts) |
| Crosslinking agent a | 5 parts |
| Inorganic fine particle a | 2 parts |
| Cationic resin a | 10 parts |
| | (solid content: 3 parts) |
| Surfactant a | 3 parts |
| | (solid content: 1 part) |
| Water | 5 parts. |

-continued

| | |
|---|---|
| (Coating conditions) | |
| Drying conditions: | 70° C./10 min. |
| Coating thickness: | 70 μm. |

TABLE 1

Constitution of transfer layers of image-transfer media of Examples 1 and 2 (*: expressed in terms of solid content)

| | Component | Content (part) |
|---|---|---|
| Ex. 1 | Fine particles of ethylene resin (Fine particle a of thermoplastic resin) | 100 |
| | Ethylene-acrylic acid copolymer emulsion (Thermoplastic resin binder a) | 10* |
| | Epoxy type crosslinking agent: Epiclon 3050 (Microcapsule a) | 10 |
| | Silica (Inorganic fine particle a) | 2 |
| | Acrylic cationic resin (Cationic resin a) | 3* |
| | Fluorine-containing surfactant (Surfactant a) | 1* |
| | Water | 10 |
| Ex. 2 | Fine particles of ethylene resin (Fine particle a of thermoplastic resin) | 100 |
| | Ethylene-acrylic acid copolymer emulsion (Thermoplastic resin binder a) | 10* |
| | Epoxy type crosslinking agent: Denacol EM-150 (Microcapsule b) | 10 |
| | Silica (Inorganic fine particle a) | 2 |
| | Acrylic cationic resin (Cationic resin a) | 3* |
| | Fluorine-containing surfactant (Surfactant a) | 1* |
| | Water | 10 |

TABLE 2

Constitution of transfer layers of image-transfer media of Examples 3 and 4 (*: expressed in terms of solid content)

| | | Component | Content (part) |
|---|---|---|---|
| Ex. 3 | | Porous fine particles of nylon resin (Fine particle b of thermoplastic resin) | 100 |
| | | Ethylene-acrylic acid copolymer emulsion (Thermoplastic resin binder a) | 90* |
| | | Urethane polymer emulsion (Thermoplastic resin binder b) | 10* |
| | | Epoxy type crosslinking agent: Denacol EM-150 (Microcapsule b) | 50 |
| | | N-Ethyl-o,p-toluenesulfonamide (Plasticizer a) | 20 |
| | | Acrylic cationic resin (Cationic resin a) | 6* |
| | | Fluorine-containing surfactant (Surfactant a) | 2* |
| | | Isopropyl alcohol (IPA) | 300 |
| Ex. 4 | First layer | Porous fine particles of nylon resin (Fine particle b of thermoplastic resin) | 100 |
| | | Ethylene-acrylic acid copolymer emulsion (Thermoplastic resin binder a) | 90* |
| | | Urethane polymer emulsion (Thermoplastic resin binder b) | 10* |
| | | N-Ethyl-o,p-toluenesulfonamide (Plasticizer a) | 20 |
| | | Acrylic cationic resin (Cationic resin a) | 6* |
| | | Fluorine-containing surfactant (Surfactant a) | 2* |

TABLE 2-continued

| Constitution of transfer layers of image-transfer media of Examples 3 and 4 (*: expressed in terms of solid content) | | |
|---|---|---|
| | Component | Content (part) |
| | Isopropyl alcohol (IPA) | 300 |
| Second layer | Epoxy type crosslinking agent: Denacol EM-150 (Microcapsule b) | 50 |
| | Ethylene-vinyl acetate copolymer emulsion (Thermoplastic resin binder c) | 50* |

TABLE 3

| Constitution of transfer layers of image-transfer media of Comparative Examples 1 to 3 (*: expressed in terms of solid content) | | |
|---|---|---|
| | Component | Content (part) |
| Comp. Ex. 1 | Fine particles of ethylene resin (Fine particle a of thermoplastic resin) | 100 |
| | Ethylene-acrylic acid copolymer emulsion (Thermoplastic resin binder a) | 10* |
| | Silica (Inorganic fine particle a) | 2 |
| | Acrylic cationic resin (Cationic resin a) | 3* |
| | Fluorine-containing surfactant (Surfactant a) | 1* |
| | Water | 10 |
| Comp. Ex. 2 | Fine particles of ethylene resin (Fine particle a of thermoplastic resin) | 100 |
| | Ethylene-acrylic acid copolymer emulsion (Thermoplastic resin binder a) | 10* |
| | Epoxy type crosslinking agent: Denacol EX-810 (Crosslinking agent a) | 5 |
| | Silica (Inorganic fine particle a) | 2 |
| | Acrylic cationic resin (Cationic resin a) | 3* |
| | Fluorine-containing surfactant (Surfactant a) | 1* |
| | Water | 10 |
| Comp. Ex. 3 | Porous fine particles of nylon resin (Fine particle b of thermoplastic resin) | 100 |
| | Ethylene-acrylic acid copolymer emulsion (ThermoplastiLc resin binder a) | 90* |
| | Urethane polymer emulsion (Thermoplastic resin binder b) | 10* |
| | N-Ethyl-o,p-toluenesulfonamide (Plasticizer a) | 20 |
| | Acrylic cationic resin (Cationic resin a) | 6* |
| | Fluorine-containing surfactant (Surfactant a) | 2* |
| | Isopropyl alcohol (IPA) | 300 |

TABLE 4

| Constitution of transfer layers of image-transfer media of Comparative Examples 4 to 6 (*: expressed in terms of solid content) | | |
|---|---|---|
| | Component | Content (part) |
| Comp. Ex. 4 | Porous fine particles of nylon resin (Fine particle b of thermoplastic resin) | 100 |
| | Ethylene-acrylic acid copolymer emulsion (Thermoplastic resin binder a) | 90* |
| | Urethane polymer emulsion (Thermoplastic resin binder b) | 10* |
| | Epoxy type crosslinking agent: Denacol EX-810 (Crosslinking agent a) | 10 |
| | N-Ethyl-o,p-toluenesulfonamide (Plasticizer a) | 20 |
| | Acrylic cationic resin (Cationic resin a) | 6* |
| | Fluorine-containing surfactant (Surfactant a) | 2* |
| | Isopropyl alcohol (IPA) | 300 |
| Comp. Ex. 5 | Porous fine particles of nylon resin (Fine particle b of thermoplastic resin) | 100 |
| | Ethylene-acrylic acid copolymer emulsion (Thermoplastic resin binder a) | 90* |
| | Urethane polymer emulsion (Thermoplastic resin binder b) | 10* |
| | Epoxy type crosslinking agent (Microcapsule c) | 50 |
| | Acrylic cationic resin (Cationic resin a) | 6* |
| | Fluorine-containing surfactant (Surfactant a) | 2* |
| | Isopropyl alcohol (IPA) | 300 |
| Comp. Ex. 6 | Fine partices of ethylene resin (Fine particle a of thermoplastic resin) | 100 |
| | Polyvinyl alcohol (Water-soluble resin binder a) | 10* |
| | Epoxy type crosslinking agent: Denacol EX-810 (Crosslinking agent a) | 5 |
| | Silica (Inorganic fine particle a) | 2 |
| | Acrylic cationic resin (Cationic resin a) | 3* |
| | Fluorine-containing surfactant (Surfactant a) | 1* |
| | Water | 5 |

EXAMPLE 5

| | |
|---|---|
| <Composition of coating formulation for first layer> | |
| Fine particle a of thermoplastic resin | 100 parts |
| Thermoplastic resin binder a | 40 parts (solid content: 10 parts) |
| Inorganic fine particle a | 2 parts |
| Cationic resin a | 10 parts (solid content: 3 parts) |
| Surfactant a | 3 parts (solid content: 1 part) |
| Water | 10 parts. |
| (Coating conditions) | |
| Drying conditions: | 70° C./10 min. |
| Coating thickness: | 70 μm. |
| <Composition of coating formulation for second layer> | |
| Crosslinking agent d | 100 parts (solid content: 50 parts) |
| Thermoplastic resin binder c | 50 parts (solid content: 20 parts) |
| Water | 5 parts. |
| (Coating conditions) | |
| Drying conditions: | 70° C./5 min. |
| Coating thickness: | 20 μm. |

EXAMPLE 6

| | |
|---|---|
| <Composition of coating formulation for first layer> | |
| Fine particle a of thermoplastic resin | 100 parts |
| Thermoplastic resin binder a | 40 parts (solid content: 10 parts) |
| Inorganic fine particle a | 2 parts |
| Cationic resin a | 10 parts (solid content: 3 parts) |
| Surfactant a | 3 parts (solid content: 1 part) |
| Water | 10 parts. |
| (Coating conditions) | |
| Drying conditions: | 70° C./10 min. |
| Coating thickness: | 70 μm. |
| <Composition of coating formulation for second layer> | |
| Crosslinking agent b | 100 parts (solid content: 50 parts) |
| Thermoplastic resin binder c | 50 parts (solid content: 20 parts). |
| (Coating conditions) | |
| Drying conditions: | 70° C./5 min. |
| Coating thickness: | 20 μm. |

EXAMPLE 7

| | |
|---|---|
| <Composition of coating formulation for first layer> | |
| Fine particle b of thermoplastic resin | 100 parts |
| Thermoplastic resin binder b | 200 parts (solid content: 80 parts) |
| Crosslinkinq agent c | 20 parts (solid content: 2 parts) |
| Plasticizer a | 20 parts |
| Cationic resin a | 20 parts (solid content: 6 parts) |
| Surfactant a | 6 parts (solid content: 2 parts) |
| Isopropyl alcohol (IPA) | 300 parts. |
| (Coating conditions) | |
| Drying conditions: | 70° C./10 min. |
| Coating thickness: | 80 μm. |
| <Composition of coating formulation for second layer> | |
| Thermoplastic resin binder a | 100 parts (solid content: 25 parts) |
| Isopropyl alcohol (IPA) | 5 parts. |
| (Coating conditions) | |
| Drying conditions: | 70° C./5 min. |
| Coating thickness: | 20 μm. |

EXAMPLE 8

| | |
|---|---|
| <Composition of coating formulation for first layer> | |
| Fine particle b of thermoplastic resin | 100 parts |
| Thermoplastic resin binder a | 400 parts (solid content: 100 parts) |
| Inorganic fine particle a | 4 parts |

-continued

| | |
|---|---|
| Plasticizer a | 20 parts |
| Cationic resin a | 50 parts (solid content: 15 parts) |
| Surfactant a | 8 parts (solid content: 2.4 parts). |
| (Coating conditions) | |
| Drying conditions: | 70° C./10 min. |
| Coating thickness: | 80 μm. |
| <Composition of coating formulation for second layer> | |
| Crosslinking agent d | 100 parts (solid content: 50 parts) |
| Thermoplastic resin binder c | 50 parts (solid content: 20 parts). |
| (Coating conditions) | |
| Drying conditions: | 70° C./5 min. |
| Coating thickness: | 20 μm. |

EXAMPLE 9

| | |
|---|---|
| <Composition of coating formulation for first layer> | |
| Fine particle b of thermoplastic resin | 100 parts |
| Thermoplastic resin binder a | 400 parts (solid content: 100 parts) |
| Inorganic fine particle a | 4 parts |
| Plasticizer a | 20 parts |
| Cationic resin a | 50 parts (solid content: 15 parts) |
| Surfactant a | 8 parts (solid content: 2.4 parts). |
| (Coating conditions) | |
| Drying conditions: | 70° C./10 min. |
| Coating thickness: | 80 μm. |
| <Composition of coating formulation for second layer> | |
| Thermoplastic resin binder c | 100 parts. |
| (Coating conditions) | |
| Drying conditions: | 110° C./5 min. |
| Coating thickness: | 5 μm. |
| <Composition of coating formulation for third layer> | |
| Crosslinking agent d | 100 parts (solid content: 50 parts) |
| Thermoplastic resin binder c | 50 parts (solid content: 20 parts). |
| (Coating conditions) | |
| Drying conditions: | 70° C./5 min. |
| Coating thickness: | 20 μm. |

Comparative Example 7

| | |
|---|---|
| <Composition of coating formulation> | |
| Fine particle a of thermoplastic resin | 100 parts |
| Thermoplastic resin binder a | 40 parts (solid content: 10 parts) |
| Inorganic fine particle a | 2 parts |
| Cationic resin a | 10 parts (solid content: 3 parts) |

-continued

| | |
|---|---|
| Surfactant a | 3 parts (solid content: 1 part) |
| Crosslinking agent d | 100 parts (solid content: 50 parts). |
| (Coating conditions) | |
| Drying conditions: | 70° C./10 min. |
| Coating thickness: | 90 μm. |

Comparative Example 8

| | |
|---|---|
| <Composition of coating formulation> | |
| Fine particle a of thermoplastic resin | 100 parts |
| Thermoplastic resin binder a | 40 parts (solid content: 10 parts) |
| Inorganic fine particle a | 2 parts |
| Cationic resin a | 10 parts (solid content: 3 parts) |
| Surfactant a | 3 parts (solid content: 1 part). |
| Crosslinking agent b | 100 parts (solid content: 50 parts) |
| Water | 10 parts. |
| (Coating conditions) | |
| Drying conditions: | 70° C./10 min. |
| Coating thickness: | 90 μm. |

Comparative Example 9

| | |
|---|---|
| <Composition of coating formulation> | |
| Fine particle b of thermoplastic resin | 100 parts |
| Thermoplastic resin binder a | 100 parts (solid content: 25 parts) |
| Thermoplastic resin binder b | 200 parts (solid content: 80 parts) |
| Crosslinking agent c | 20 parts (solid content: 2 parts) |
| Plasticizer a | 20 parts |
| Cationic resin a | 20 parts (solid content: 6 parts) |
| Surfactant a | 6 parts (solid content: 2 parts) |
| Isopropyl alcohol (IPA) | 300 parts. |
| (Coating conditions) | |
| Drying conditions: | 70° C./10 min. |
| Coating thickness: | 100 μm. |

Comparative Example 10

| | |
|---|---|
| <Composition of coating formulation> | |
| Fine particle b of thermoplastic resin | 100 parts |
| Thermoplastic resin binder a | 400 parts (solid content: 100 parts) |
| Inorganic fine particle a | 4 parts |
| Plasticizer a | 20 parts |
| Cationic resin a | 50 parts (solid content: 15 parts) |
| Surfactant a | 8 parts (solid content: 2.4 parts) |

-continued

| | |
|---|---|
| Crosslinking agent b | 100 parts (solid content: 50 parts). |
| (Coating conditions) | |
| Drying conditions: | 70° C./10 min. |
| Coating thickness: | 100 μm. |

Comparative Example 11

| | |
|---|---|
| <Composition of coating formulation for first layer> | |
| Fine particle a of thermoplastic resin | 100 parts |
| Water-soluble resin binder a | 50 parts (solid content: 10 parts) |
| Inorganic fine particle a | 2 parts |
| Cationic resin a | 10 parts (solid content: 3 parts) |
| Surfactant a | 3 parts (solid content: 1 part) |
| Water | 5 parts. |
| (Coating conditions) | |
| Drying conditions: | 70° C./10 min. |
| Coating thickness: | 70 μm. |
| <Composition of coating formulation for second layer> | |
| Crosslinking agent d | 100 parts (solid content: 50 parts). |
| Thermoplastic resin binder c | 50 parts (solid content: 50 parts) |
| Water | 5 parts. |
| (Coating conditions) | |
| Drying conditions: | 70° C./5 min. |
| Coating thickness: | 20 μm. |

EXAMPLE 10

A coating formulation a having the following composition was applied to a base material a to produce an image-transfer medium a. On the other hand, a coating formulation b having the following composition was applied to another base material a to produce an image-transfer medium b.

| | |
|---|---|
| <Composition of coating formulation a> | |
| Fine particle b of thermoplastic resin | 100 parts |
| Thermoplastic resin binder a | 400 parts (solid content: 100 parts) |
| Inorganic fine particle a | 4 parts |
| Plasticizer a | 20 parts |
| Cationic resin a | 50 parts (solid content: 15 parts) |
| Surfactant a | 8 parts (solid content: 2.4 parts). |
| (Coating conditions) | |
| Drying conditions: | 70° C./10 min. |
| Coating thickness: | 80 μm. |
| <Composition of coating formulation b> | |
| Crosslinking agent d | 100 parts (solid content: 50 parts) |
| Thermoplastic resin binder c | 50 parts (solid content: 50 parts). |

-continued

| (Coating conditions) | |
|---|---|
| Drying conditions: | 70° C./5 min. |
| Coating thickness: | 20 μm. |

TABLE 5

Constitution of transfer layers of image-transfer media of Examples 5 and 6 (*: expressed in terms of solid content)

| | Component | | Content (part) |
|---|---|---|---|
| Ex. 5 | First layer | Fine particles of ethylene resin (Fine particle a of thermoplastic resin) | 100 |
| | | Ethylene-acrylic acid copolymer emulsion (Thermoplastic resin binder a) | 10* |
| | | Silica (Inorganic fine particle a) | 2 |
| | | Acrylic cationic resin (Cationic resin a) | 3* |
| | | Fluorine-containing surfactant (Surfactant a) | 1* |
| | | Water | 10 |
| | Second layer | Epoxy type crosslinking agent: EP-1005 (Crosslinking agent d) | 50* |
| | | Ethylene-vinyl acetate copolymer emulsion (Thermoplastic resin binder c) | 20* |
| | | Water | 5 |
| Ex. 6 | First layer | Fine particles of ethylene resin (Fine particle a of thermoplastic resin) | 100 |
| | | Ethylene-acrylic acid copolymer emulsion (Thermoplastic resin binder a) | 10* |
| | | Silica (Inorganic fine particle a) | 2 |
| | | Acrylic cationic resin (Cationic resin a) | 3* |
| | | Fluorine-containing surfactant (Surfactant a) | 1* |
| | | Water | 10 |
| | Second layer | Epoxy type crosslinking agent: Denacol EM-150 (Crosslinking agent b) | 50* |
| | | Ethylene-vinyl acetate copolymer emulsion (Thermoplastic resin binder c) | 20* |

TABLE 6

Constitution of transfer layers of image-transfer media of Examples 7 and 8 (*: expressed in terms of solid content)

| | Component | | Content (part) |
|---|---|---|---|
| Ex. 7 | First layer | Porous fine particles of nylon resin (Fine particle b of thermoplastic resin) | 100 |
| | | Urethane polymer emulsion (Thermoplastic resin binder b) | 80* |
| | | Metal oxide type crosslinking agent: zinc oxide (Crosslinking agent c) | 2* |
| | | N-Ethyl-o,p-toluenesulfonamide (Plasticizer a) | 20 |
| | | Acrylic cationic resin (Cationic resin a) | 6* |
| | | Fluorine-containing surfactant (Surfactant a) | 2* |

TABLE 6-continued

Constitution of transfer layers of image-transfer media of Examples 7 and 8 (*: expressed in terms of solid content)

| | Component | | Content (part) |
|---|---|---|---|
| | | Isopropyl alcohol (IPA) | 300 |
| | Second layer | Ethylene-acrylic acid copolymer emulsion (Thermoplastic resin binder a) | 25* |
| | | Isopropyl alcohol (IPA) | 5 |
| Ex. 8 | First layer | Porous fine particles of nylon resin (Fine particle b of thermoplastic resin) | 100 |
| | | Ethylene-acrylic acid copolymer emulsion (Thermoplastic resin binder a) | 100* |
| | | Silica (Inorganic fine particle a) | 4 |
| | | N-Ethyl-o,p-toluenesulfonamide (Plasticizer a) | 20 |
| | | Acrylic cationic resin (Cationic resin a) | 15* |
| | | Fluorine-containing surfactant (Surfactant a) | 2.4* |
| | Second layer | Epoxy type crosslinking agent: EP-1005 (Crosslinking agent d) | 50* |
| | | Ethylene-vinyl acetate copolymer emulsion (Thermoplastic resin binder c) | 50* |

TABLE 7

Constitution of transfer layers of image-transfer media of Examples 9 and 10 (*: expressed in terms of solid content)

| | Component | | Content (part) |
|---|---|---|---|
| Ex. 9 | First layer | Porous fine particles of nylon resin (Fine particle b of thermoplastic resin) | 100 |
| | | Ethylene-acrylic acid copolymer emulsion (Thermoplastic resin binder a) | 100* |
| | | Silica (Inorganic fine particle a) | 4 |
| | | N-Ethyl-o,p-toluenesulfonamide (Plasticizer a) | 20 |
| | | Acrylic cationic resin (Cationic resin a) | 15* |
| | | Fluorine-containing surfactant (Surfactant a) | 2.4* |
| | Second layer | Ethylene-vinyl acetate copolymer emulsion (Thermoplastic resin binder c) | 100 |
| | Third layer | Epoxy type crosslinking agent: EP-1005 (Crosslinking agent d) | 50* |
| | | Ethylene-vinyl acetate copolymer emulsion (Thermoplastic resin binder c) | 50* |
| Ex. 10 | Image-transfer medium a | Porous fine particles of nylon resin (Fine particle b of thermoplastic resin) | 100 |
| | | Ethylene-acrylic acid copolymer emulsion (Thermoplastic resin binder a) | 100* |
| | | Silica (Inorganic fine particle a) | 4 |
| | | N-Ethyl-o,p-toluenesulfonamide (Plasticizer a) | 20 |
| | | AcryLic cationic resin (Cationic resin a) | 15* |
| | | Fluorine-containing surfactant (Surfactant a) | 2.4* |
| | Image-transfer | Epoxy type crosslinking agent: EP-1005 (Crosslinking agent d) | 50* |

TABLE 7-continued

| Constitution of transfer layers of image-transfer media of Examples 9 and 10 (*: expressed in terms of solid content) | | |
|---|---|---|
| Component | | Content (part) |
| medium b | Ethylene-vinyl acetate copolymer emulsion (Thermoplastic resin binder c) | 50* |

TABLE 8

| Constitution of transfer layers of image-transfer media of Comparative Examples 7 to 9 (*: expressed in terms of solid content) | | |
|---|---|---|
| Component | | Content (part) |
| Comp. Ex. 7 | Fine particles of ethylene resin (Fine particle a of thermoplastic resin) | 100 |
| | Ethylene-acrylic acid copolymer emulsion (Thermoplastic resin binder a) | 10* |
| | Silica (Inorganic fine particle a) | 2 |
| | Acrylic cationic resin (Cationic resin a) | 3* |
| | Fluorine-containing surfactant (Surfactant a) | 1* |
| | Epoxy type crosslinking agent: EP-1005 (Crosslinkinq aqent d) | 50* |
| | Water | 10 |
| Comp. Ex. 8 | Fine particles of ethylene resin (Fine particle a of thermoplastic resin) | 100 |
| | Ethylene-acrylic acid copolymer emulsion (Thermoplastic resin binder a) | 10* |
| | Silica (Inorganic fine particle a) | 2 |
| | Acrylic cationic resin (Cationic resin a) | 3* |
| | Fluorine-containing surfactant (Surfactant a) | 1* |
| | Epoxy type crosslinking agent: Denacol EM-150 (Crosslinking agent b) | 50* |
| | Water | 10 |
| Comp. Ex. 9 | Porous fine particles of nylon resin (Fine particle b of thermoplastic resin) | 100 |
| | Ethylene-acrylic acid copolymer emulsion (Thermoplastic resin binder a) | 25* |
| | Urethane polymer emulsion (Thermoplastic resin binder b) | 80* |
| | Metal oxide type crosslinking agent: zinc oxide (Crosslinking agent c) | 2* |
| | N-Ethyl-o,p-toluenesulfonamide (Plasticizer a) | 20 |
| | Acrylic cationic resin (Cationic resin a) | 6* |
| | Fluorine-containing surfactant (Surfactant a) | 2* |
| | Isopropyl alcohol (IPA) | 300 |

TABLE 9

| Constitution of transfer layers of image-transfer media of Comparative Examples 10 and 11 (*: expressed in terms of solid content) | | |
|---|---|---|
| Component | | Content (part) |
| Comp. Ex. 10 | Porous fine particles of nylon resin (Fine particle b of thermoplastic resin) | 100 |
| | Ethylene-acrylic acid copolymer emulsion (Thermoplastic resin binder a) | 100* |
| | Silica (Inorganic fine particle a) | 4 |
| | N-Ethyl-o,p-toluenesulfonamide (Plasticizer a) | 20 |
| | Acrylic cationic resin (Cationic resin a) | 15* |
| | Fluorine-containing surfactant (Surfactant a) | 2.4* |
| | Epoxy type crosslinking agent: EP-1005 (Crosslinking agent d) | 50 |
| Comp. Ex. 11 | First layer: Fine particles of Ethylene resin (Fine particle a of thermoplastic resin) | 100 |
| | Polyvinyl alcohol (Water-soluble resin binder a) | 10* |
| | Silica (Inorganic fine particle a) | 2 |
| | Acrylic cationic resin (Cationic resin a) | 3* |
| | Fluorine-containing surfactant (Surfactant a) | 1* |
| | Water | 5 |
| | Second layer: Epoxy type crosslinking agent: EP-1005 (Crosslinking agent d) | 50* |
| | Ethylene-vinyl acetate copolymer emulsion (Thermoplastic resin binder c) | 50* |
| | Water | 5 |

Printing was conducted on the thus-produced image-transfer media (image-transfer medium a in the case of Example 10) of Examples 1 to 10 and Comparative Examples 1 to 11 in accordance with a back printing film mode by means of an ink-jet color printer, BJC-600J (trade name, manufactured by Canon Inc.). After the printing, each of the image-transfer media thus printed was placed on a 100% cotton T-shirt (BEEFY, trade name; product of HANES Co.) with a side of the transfer layer of the image-transfer medium, on which the image had been formed. The transfer layer was transferred to the T-shirt by heating it by means of a heat transfer machine (surface temperature of hot plate: 200° C.; transfer pressure: 80 g/cm$^2$) from the base material side of the image-transfer medium to form a transferred image. In the case of Example 10, the image-transfer medium b was additionally transferred. Each transferred image thus formed was evaluated as to (1) fastness to washing, (2) transferability, (3) shelf stability of image-transfer medium and (4) bleeding of image at boundary in accordance with the following respective evaluation methods.

(1) Fastness to Washing

Each of the T-shirts with the transferred image formed thereon in the above-described manner was subjected each 10 times to washing for 10 minutes and rinsing for 10 minutes by a household two-tub washing machine, dewatered and then dried in a dryer. The degree of decoloring at the transfer-printed portion of the T-shirt thus washed and dried was visually observed to evaluate the sample as to the fastness to washing in accordance with the following standard. The transferred image formed on the T-shirt was composed of black, cyan, magenta and yellow print patches (each, 15 mm×15 mm) of 100% duty at all pixels.

A: No decoloring occurred;

B: Decoloring somewhat occurred; and

C: Decoloring occurred to a considerable extent.

(2) Transferability

The degree of separation at the transfer-printed portion of each of the washed and dried T-shirts after subjected to the evaluation test as to the fastness to washing was visually observed to evaluate the sample as to the transferability in accordance with the following standard:

A: The transfer layer was not separated;

B: The transfer layer was partially separated; and

C: The transfer layer was separated as a whole.

(3) Shelf Stability of Image-Transfer Medium

After the thus produced image-transfer media (sheets) of Examples 1 to 10 and Comparative Examples 1 to 11 were placed in a polypropylene bag and left to stand for 2 days in a thermostatic chamber controlled at 60° C. and 50% relative humidity, each of them was used to transfer-print an image on a T-shirt in the same manner as described above, thereby forming a transferred image. The T-shirt thus transfer-printed was then evaluated as to (1) fastness to washing and (2) transferability in the same manner as described above, thereby regarding the evaluation results thereof as the evaluation as to (3) shelf stability of image-transfer medium.

The evaluation results of the Examples and Comparative Examples are shown in Tables 10 and 11.

TABLE 10

| | Evaluation results | | | | |
|---|---|---|---|---|---|
| | Before storage | | After storage (shelf stability of sheet) | | |
| | (1) | (2) | (1) | (2) | Remarks |
| Ex. 1 | A | A | A | A | Surface-coated crosslinking agent |
| Ex. 2 | A | A | A | A | Surface-coated crosslinking agent |
| Ex. 3 | A | A | A | A | Surface-coated crosslinking agent |
| Ex. 4 | A | A | A | A | Surface-coated crosslinking agent (transfer layer composed of 2 layers) |
| Comp. Ex. 1 | C | A | C | A | Containing no crosslinking agent |
| Comp. Ex. 2 | A | A | — | C | Surface-uncoated crosslinking agent |
| Comp. Ex. 3 | C | A | C | A | Containing no crosslinking agent |
| Comp. Ex. 4 | A | A | — | C | Surface-uncoated crosslinking agent |
| Comp. Ex. 5 | C | B | C | B | Surface-coated crosslinking agent (coated with thermo-setting resin) |
| Comp. Ex. 6 | B | B | B | B | Surface-uncoated crosslinking agent |

(Note)
(1): Fastness to washing.
(2): Transferability.

TABLE 11

| | Evaluation results | | | | |
|---|---|---|---|---|---|
| | Before storage | | After storage (shelf stability of sheet) | | |
| | (1) | (2) | (1) | (2) | Remarks |
| Ex. 5 | A | A | A | A | Two-layer structure |
| Ex. 6 | A | A | A | A | Two-layer structure |
| Ex. 7 | A | A | A | A | Two-layer structure |
| Ex. 8 | A | A | A | A | Two-layer structure |
| Ex. 9 | A | A | A | A | Three-layer structure |
| Ex. 10 | A | A | A | A | Composed of image-transfer media a and b |
| Comp. Ex. 7 | A | A | A | C | One-layer structure |
| Comp. Ex. 8 | A | A | A | C | One-layer structure |
| Comp. Ex. 9 | A | B | A | C | One-layer structure |
| Comp. Ex. 10 | A | A | A | C | One-layer structure |
| Comp. Ex. 11 | B | B | B | B | Two-layer structure (containing a material reactive to the crosslinking agent in the layer of cross-linking agent) |

(Note)
(1): Fastness to washing.
(2): Transferability.

(4) Bleeding of Image at Boundary

An image formed on each of the thus-produced image-transfer media (image-transfer medium a in the case of Example 10) of Examples 1 to 10 and Comparative Examples 1 to 11 by adjoiningly printing black and magenta print patches of 100% duty, in which dots were formed in all pixels, in accordance with the same printing process as described above was transfer-printed on a T-shirt in the same manner as described above to form a transferred image. The transferred image on the T-shirt thus obtained was visually observed to examine whether bleeding occurred at the boundary between the two colors or not. As a result, it was found that no bleeding occurred at the boundary between the two colors even when any of the image-transfer media of Examples 1 to 10 and Comparative Examples 1 to 11 was used.

According to the present invention, as described above, there can be provided image-transfer media for ink-jet printing, which always permit the simple and stable formation of satisfactory transferred images on transfer-printing media such as cloths making good use of an ink-jet printing system and have excellent shelf stability. In particular, the use of such an image-transfer medium permits the formation of a high-density and clear transferred image because of its high ink absorbency. In addition, a transfer-printing medium such as a cloth with a transferred image formed thereon using the image-transfer medium according to the present invention is soft and excellent in hand even at the portion on which the transferred image has been formed, and has high fastness to washing.

What is claimed is:

1. An image-transfer medium for ink-jet printing, comprising a base material, and a releasing layer and a transfer layer both provided on the base material, wherein the transfer layer comprises fine particles of a water-insoluble thermoplastic resin, a water-insoluble thermoplastic resin binder and a crosslinking agent coated with a thermoplastic resin having substantially no reactivity to the crosslinking agent, wherein the crosslinking agent has a particle size of 0.05 to 100 $\mu$m and is solid at room temperature and develops reactivity by heating.

2. The image-transfer medium according to claim 1, wherein a weight ratio of the fine particles of the water-insoluble thermoplastic resin to the water-insoluble thermoplastic resin binder falls within a range of from 1/2 to 50/1.

3. The image-transfer medium according to claim 2, wherein the weight ratio falls within a range of from 1/2 to 20/1.

4. The image-transfer medium according to claim 1, wherein the crosslinking agent has a melting point of 70° C. or more.

5. The image-transfer medium according to claim 1, wherein the crosslinking agent is an epoxy type crosslinking agent, and the thermoplastic resin with which the crosslinking agent is coated is polyethylene.

6. A process for producing a transferred image, comprising the steps of:

forming an image on the transfer layer of the image-transfer medium for ink-jet printing according to claim 1 in accordance with an ink-jet printing system; and transferring the transfer layer to the transfer-printing medium, by overlapping the image-transfer medium, on which the image has been formed, and a transfer-printing medium on each other.

* * * * *

UNITED STATES PATENT AND TRADEMARK OFFICE

CERTIFICATE OF CORRECTION

PATENT NO. : 6,652,928 B2
DATED : November 25, 2003
INVENTOR(S) : Yuko Sato et al.

It is certified that error appears in the above-identified patent and that said Letters Patent is hereby corrected as shown below:

Title page,
Item [57], ABSTRACT,
Line 3, “both,” should read -- both --.

Column 14,
Line 30, “each other” should be deleted.

Column 21,
Line 43, “(ThermoplastiLc” should read -- (Thermoplastic --.

Column 30,
Line 67, “after” should read -- after being --.

Signed and Sealed this

Fifteenth Day of June, 2004

JON W. DUDAS
*Acting Director of the United States Patent and Trademark Office*